US006425631B1

(12) United States Patent
Lin

(10) Patent No.: US 6,425,631 B1
(45) Date of Patent: Jul. 30, 2002

(54) COMPUTER CHAIR ASSEMBLY

(75) Inventor: Kwan-Yi Lin, Gia Yi Hsien (TW)

(73) Assignee: King Pao Enterprise Co., LTD, Gia Yi Hsien (TW)

( * ) Notice: Subject to any disclaimer, the term of this patent is extended or adjusted under 35 U.S.C. 154(b) by 0 days.

(21) Appl. No.: 09/828,416

(22) Filed: Apr. 6, 2001

(51) Int. Cl.[7] ..... A47B 83/02

(52) U.S. Cl. ..... 297/173; 297/174 R; 297/170; 297/188.14

(58) Field of Search ..... 297/170, 172, 297/173, 174 R, 148, 154, 155, 188.14, 188.15, 188.18

(56) References Cited

U.S. PATENT DOCUMENTS 5,779,305 A * 7/1998 Hocking ..... 297/170
5,893,607 A * 4/1999 Trimnel ..... 297/174
6,145,926 A * 11/2000 Lin ..... 297/170

* cited by examiner

*Primary Examiner*—Anthony D. Barfield
(74) *Attorney, Agent, or Firm*—Alan Kamrath; Rider, Bennett, Egan & Arundel, LLP

(57) ABSTRACT

A computer chair assembly has a chair having two armrests, a pivot shaft disposed on one of the armrests, a U-shaped rod, a generally L-shaped hollow rod disposed on the U-shaped rod, the generally L-shaped hollow rod having a distal end connected to the pivot shaft and a plurality of lugs, a pivot bar having a first end collar connected to one of the lugs and a second end collar connected to an oblong plate.

3 Claims, 6 Drawing Sheets

COMPUTER CHAIR ASSEMBLY

BACKGROUND OF THE INVENTION

The present invention relates to a computer chair assembly. More particularly, the present invention relates to a computer chair assembly which can be operated easily.

Referring to FIG. 1, a conventional support frame 100 is connected to a chair (not shown in the figure). However, the conventional support frame 100 cannot receive a lot of articles.

SUMMARY OF THE INVENTION

An object of the present invention is to provide a computer chair assembly which can be operated easily.

Another object of the present invention is to provide a computer chair assembly which can receive a lot of articles.

Accordingly, a computer chair assembly comprises a chair having two armrests, a pivot shaft disposed on one of the armrests, a U-shaped rod, a generally L-shaped hollow rod disposed on the U-shaped rod, and the generally L-shaped hollow rod having a distal end connected to the pivot shaft and at least a first lug and a second lug. A first article support frame has a first plate and a third lug disposed on the first plate. A second article support frame has a second plate and a fourth lug disposed on the second plate. A first pivot bar has a first end collar connected to the first lug and a second end collar connected to the third lug. A first bolt fastens the first end collar and the first lug together. A second bolt fastens the second end collar and the third lug together. A second pivot bar has a third end collar connected to the second lug and a fourth end collar connected to the fourth lug. A third bolt fastens the third end collar and the second lug together. A fourth bolt fastens the fourth end collar and the fourth lug together.

DETAILED DESCRIPTION OF THE INVENTION

Figure 1:
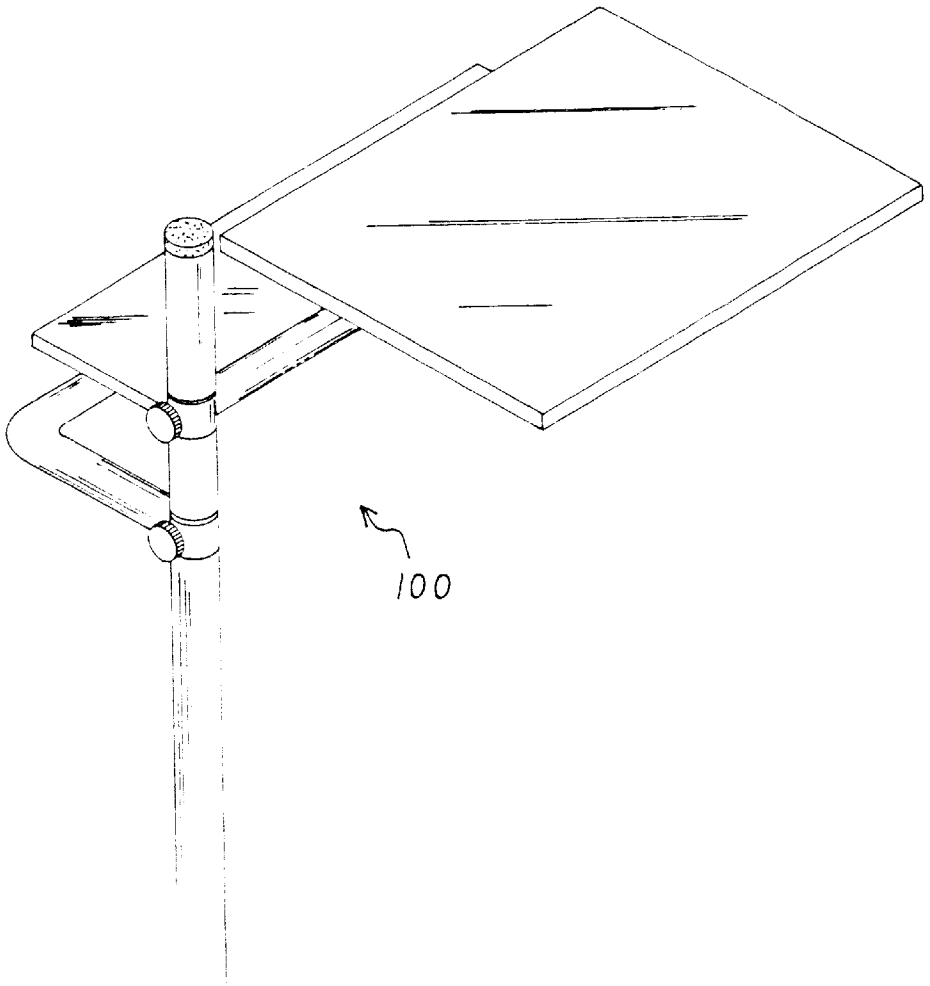
FIG. 1 PRIOR ART
FIG. 1 is a perspective view of a computer support frame of the prior art.
Figure 2:
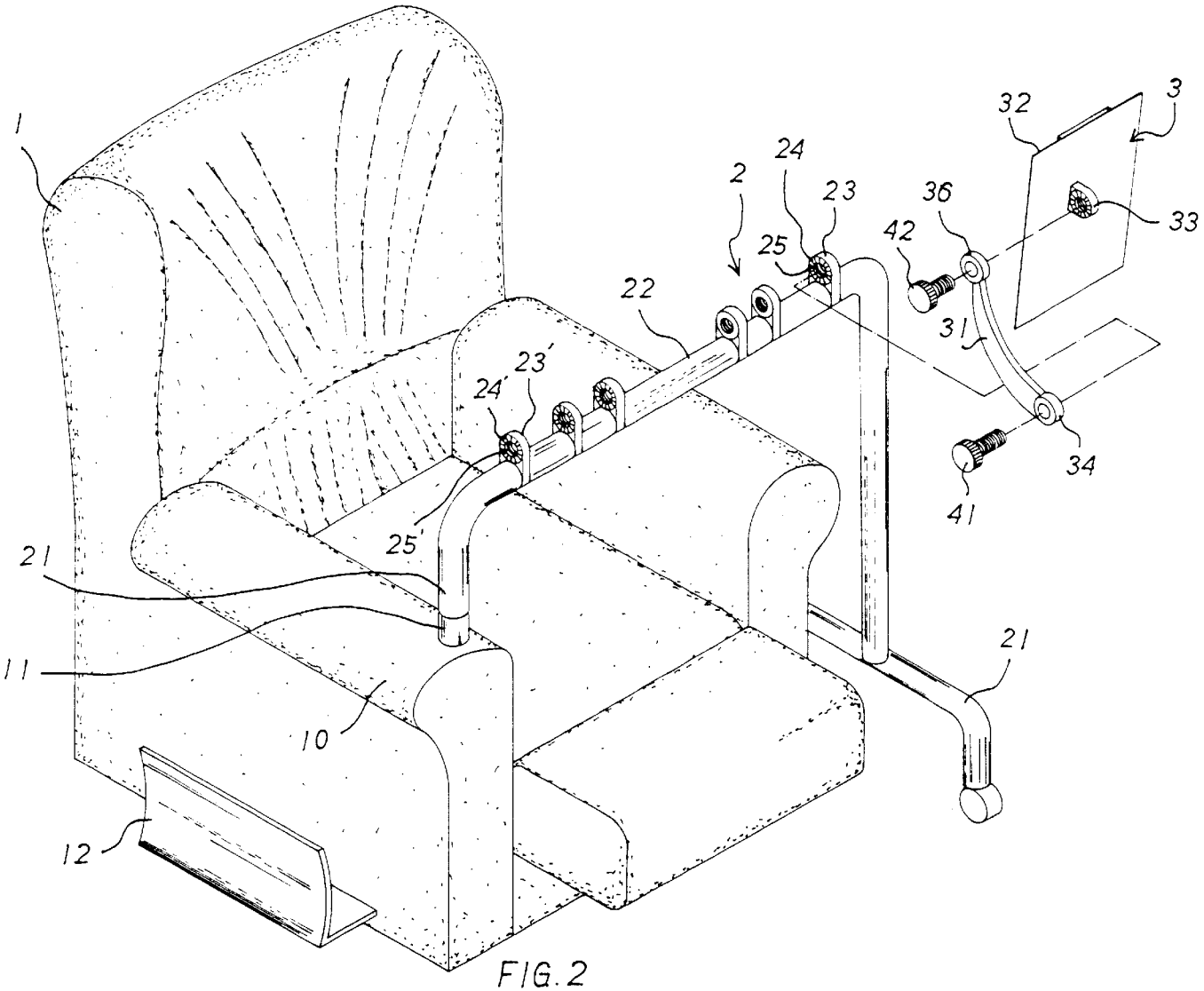
FIG. 2 is a partially perspective exploded view of a computer chair assembly of a preferred embodiment in accordance with the present invention.
Figure 3:
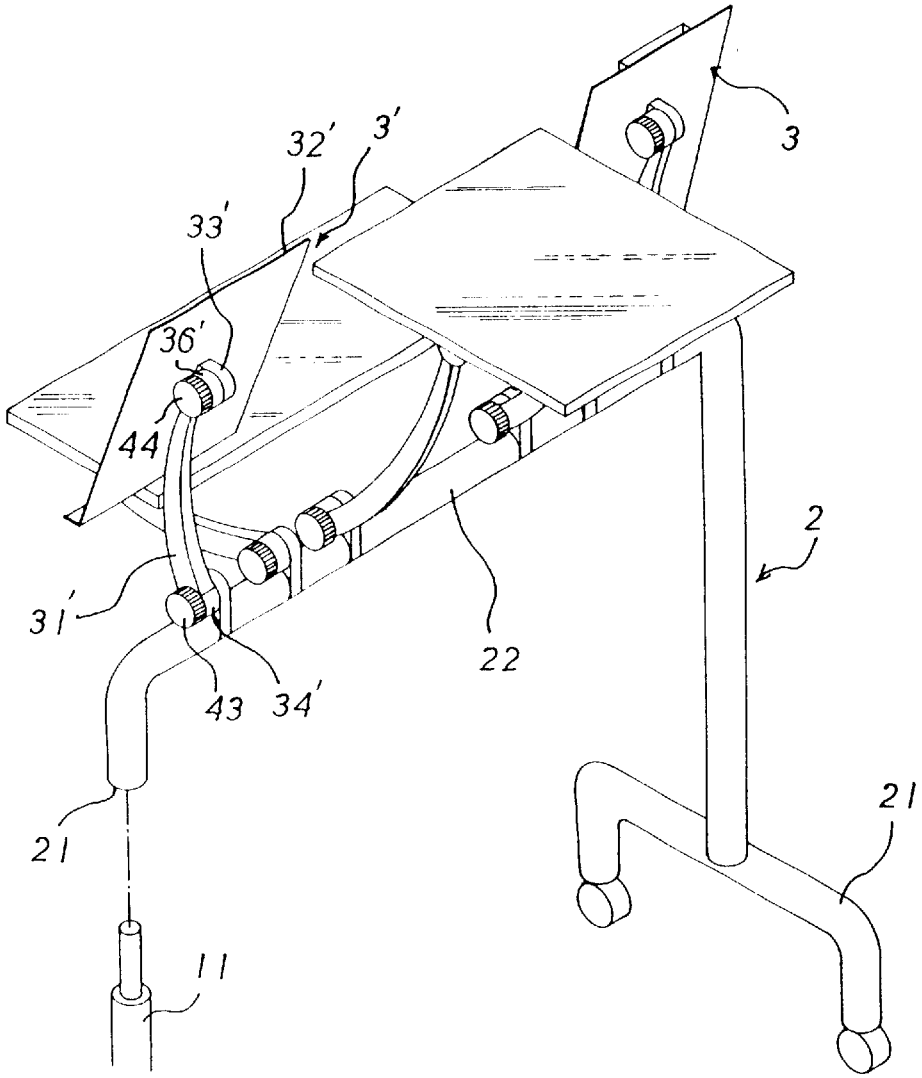
FIG. 3 is a partially perspective view of a computer chair assembly of a preferred embodiment without a chair.
Figure 4:
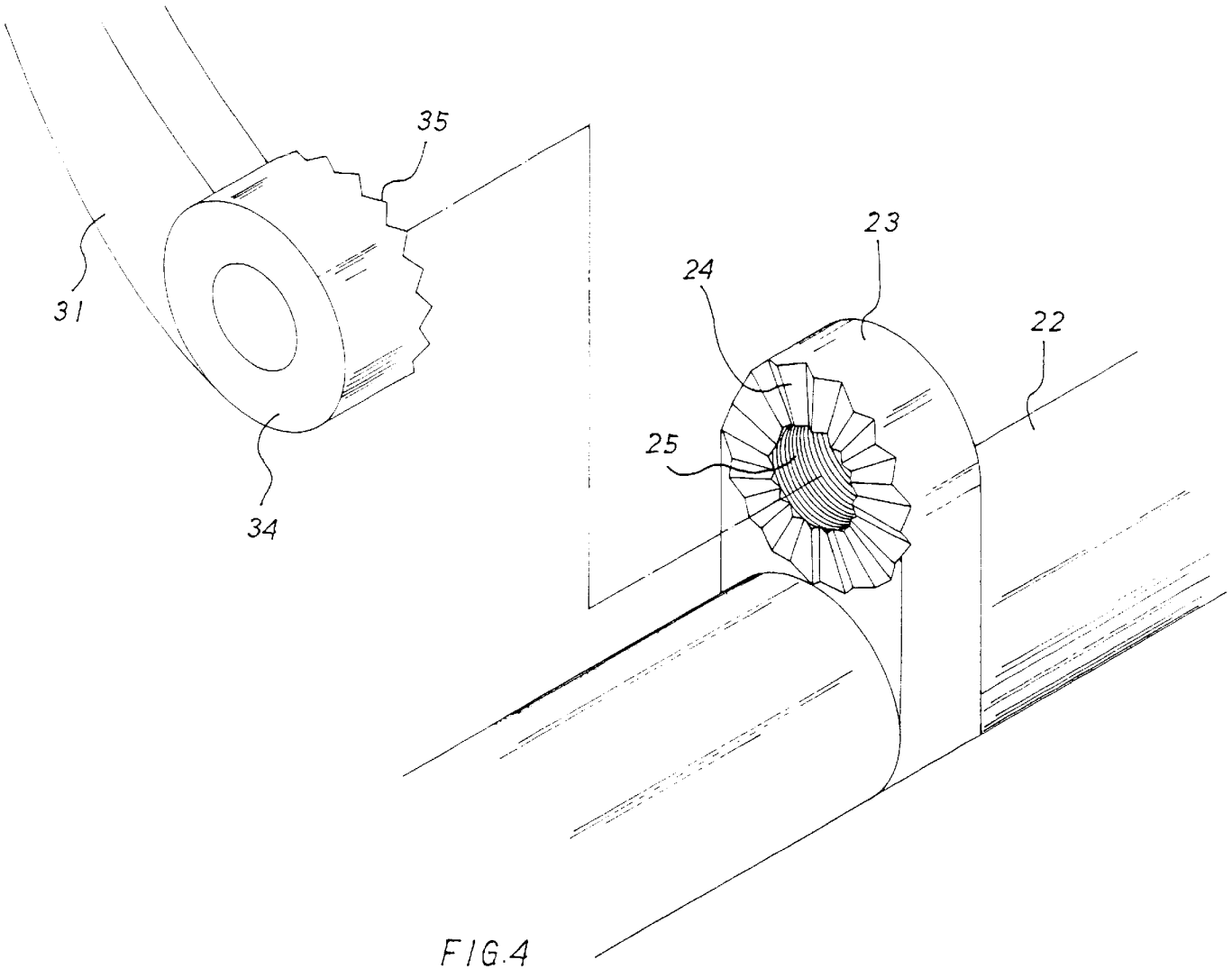
FIG. 4 is a perspective exploded view of a first lug and a first collar of a preferred embodiment in accordance with the present invention.
Figure 5:
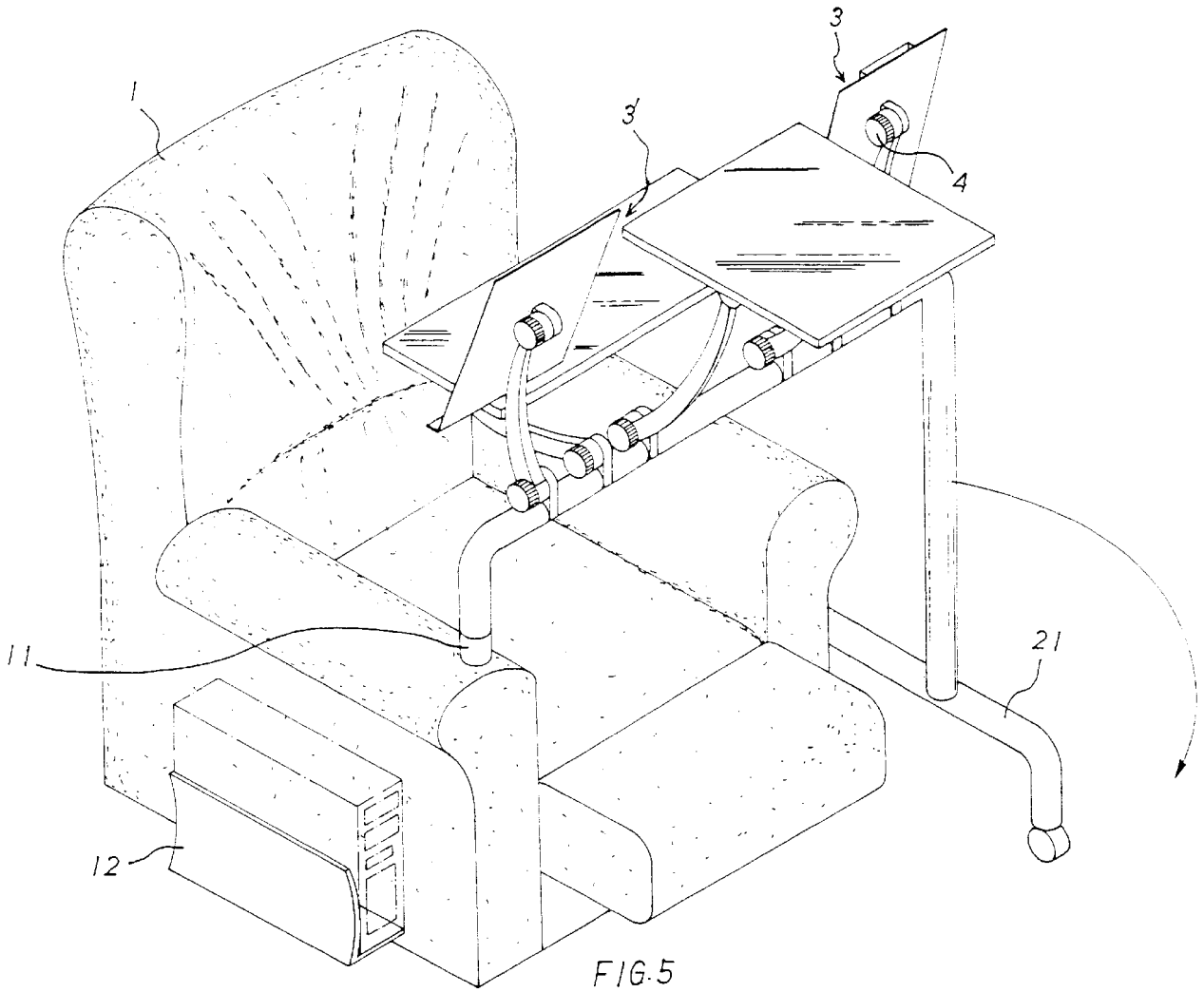
FIG. 5 is a perspective assembly view of a computer chair assembly of a preferred embodiment in accordance with the present invention.
Figure 6:
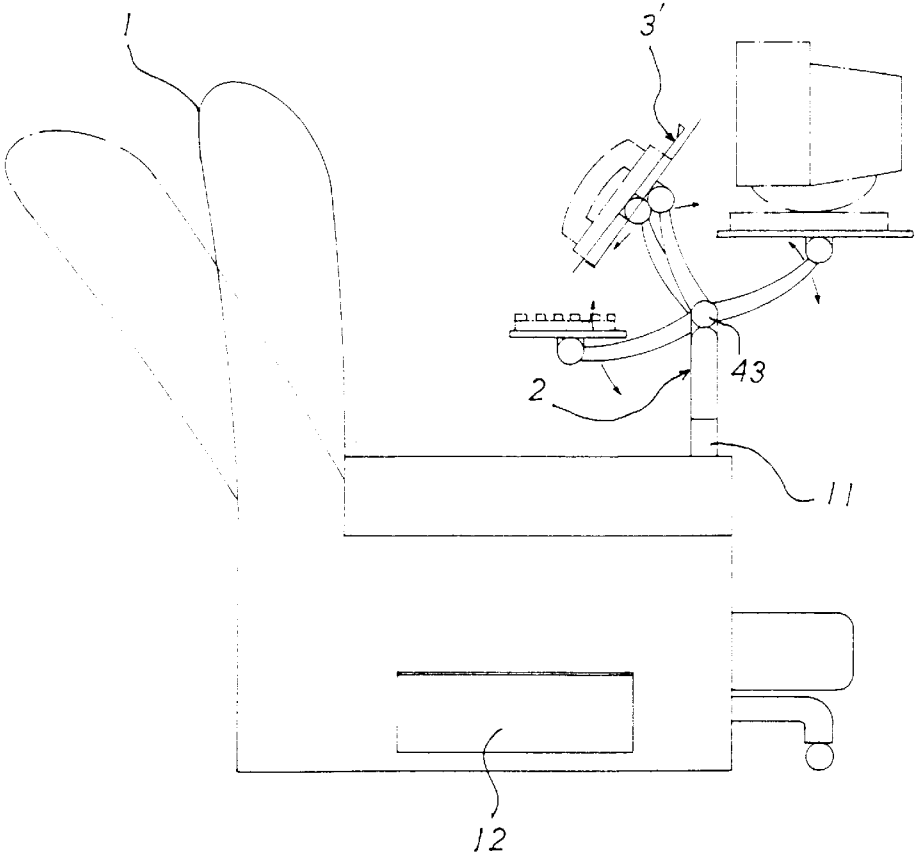
FIG. 6 is a schematic view illustrating an operation of a computer chair assembly of a preferred embodiment in accordance with the present invention.

Referring to FIGS. 2 to 6, a computer chair assembly comprises a chair 1 having two armrests 10, a pivot shaft 11 disposed on one of the armrests 10, a U-shaped rod 21, a generally L-shaped hollow rod 2 disposed on the U-shaped rod 21, and the generally L-shaped hollow rod 2 having a distal end 21 connected to the pivot shaft 11 and at least a first lug 23 and a second lug 23' disposed on a transverse portion 22 of the generally L-shaped hollow rod 2.

A first article support frame 3 has a first plate 32 and a third lug 33 disposed on the first plate 32.

A second article support frame 3' has a second plate 32' and a fourth lug 33' disposed on the second plate 32'.

A first pivot bar 31 has a first end collar 34 connected to the first lug 23 and a second end collar 36 connected to the third lug 33.

A first bolt 41 fastens the first end collar 34 and the first lug 23 together.

A second bolt 42 fastens the second end collar 36 and the third lug 33 together.

A second pivot bar 31' has a third end collar 34' connected to the second lug 23' and a fourth end collar 36' connected to the fourth lug 33'.

A third bolt 43 fastens the third end collar 34' and the second lug 23' together.

A fourth bolt 44 fastens the fourth end collar 36' and the fourth lug 33' together.

The first lug 23 has a first ratchet ring 24 and a first inner threaded hole 25.

The first end collar 34 has a second ratchet ring 35 engaging with the first ratchet ring 24 of the first lug 23.

The second lug 23' has a third ratchet ring 24' and a second inner threaded hole 25'.

An L-shaped bar 12 is disposed on the chair 1.

The angle of the first pivot bar 31 and the angle of the second pivot bar 31' can be adjusted.

The invention is not limited to the above embodiment but various modification thereof may be made. Further, various changes in form and detail may be made without departing from the scope of the invention.

I claim:

1. A computer chair assembly comprises:

a chair having two armrests, a pivot shaft disposed on one of the armrests, a U-shaped rod, a generally L-shaped hollow rod disposed on the shaped rod, the generally L-shaped hollow rod having a distal end connected to the pivot shaft and at least a first lug end a second lug, a first article support frame having a first plate and a third lug disposed on the first plate, a second article support frame having a second plate and a fourth lug disposed on the second plate, a first pivot bar having a first end collar connected to the first lug and a second end collar connected to the third lug, a first bolt fastening the first end collar and the first lug together, a second bolt fastening the second end collar and the third lug together, a second pivot bar having a third end collar connected to the second lug and a fourth end collar connected to the fourth lug, a third bolt fastening the third end collar and the second lug together, and a fourth bolt fastening the fourth end collar and the fourth lug together.

2. The computer chair assembly as claimed in claim 1, wherein the first lug has a first ratchet ring and the first end collar has a second ratchet ring engaging with the first ratchet ring of the first lug.

3. The computer chair assembly as claimed in claim 1, wherein an L-shaped bar is disposed on the chair.

* * * * *